United States Patent [19]

Ramadorai et al.

[11] 4,329,223

[45] May 11, 1982

[54] FLOTATION OF MOLYBDENITE

[75] Inventors: Gopalan Ramadorai, Fullerton, Calif.; Douglas R. Shaw, Tucson, Ariz.

[73] Assignee: United States Borax & Chemical Corporation, Los Angeles, Calif.

[21] Appl. No.: 111,434

[22] Filed: Jan. 11, 1980

[51] Int. Cl.[3] ..... B03D 1/06

[52] U.S. Cl. ..... 209/167

[58] Field of Search ..... 209/167, 166

[56] References Cited

U.S. PATENT DOCUMENTS

| | | | |
|---|---|---|---|
| 1,261,810 | 4/1918 | Hebbard | 209/167 |
| 2,449,984 | 9/1948 | Gibbs | 209/167 |
| 2,559,104 | 7/1951 | Arbiter | 209/167 X |
| 2,957,576 | 10/1960 | Henderson | 209/167 |
| 3,400,817 | 9/1968 | Burwell | 209/167 |
| 3,785,488 | 1/1974 | Werneke | 209/167 |
| 3,811,569 | 8/1974 | Shirley | 209/167 |
| 4,196,073 | 4/1980 | Gannon | 209/167 |
| 4,231,859 | 11/1980 | Huiatt | 209/167 |
| 4,268,380 | 5/1981 | Shaw | 209/167 |

FOREIGN PATENT DOCUMENTS

| | | | |
|---|---|---|---|
| 358460 | 4/1930 | United Kingdom | 209/167 |
| 373662 | 6/1932 | United Kingdom | 209/167 |

*Primary Examiner*—Robert Halper

*Attorney, Agent, or Firm*—James R. Thornton

[57] ABSTRACT

Molybdenite is recovered by froth flotation of ore or concentrate by use of thio carboxylic acid compound and activated carbon to depress copper and other metal sulfides. The reagents are preferably utilized in a weight ratio of about 1:1.

8 Claims, No Drawings

FLOTATION OF MOLYBDENITE

This invention relates to the flotation recovery of molybdenite and especially to the depression of undesirable metal sulfides in the froth flotation of molybdenite.

BACKGROUND OF THE INVENTION

A major source of molybdenum metal is the mineral molybdenite ($MoS_2$) which occurs frequently as a constituent of other metal sulfide ores or may occur as a primary molybdenite ore with only minor amounts of other metal sulfides. Frequently, molybdenite is a minor constituent of copper sulfide ores, and a major source of molybdenite in the United States is as a by-product of copper ore processing in which the molybdenite is separated from the copper and other sulfide constituents by a froth flotation procedure. Molybdenite is also obtained from primary molybdenite ores by use of a series of froth flotation procedures to obtain a concentrate high in molybdenum sulfide but containing minor amounts of copper sulfide contaminant. Such copper is undesirable since the molybdenite concentrate is usually converted to molybdenum oxide or ferromolybdenum for use by the iron and steel industry which requires the copper content to be low, generally less than 1%.

According to the present practice of the industry, undesirable metal sulfides such as copper and iron sulfide are controlled by use of sodium cyanide or Nokes reagent as a depressant in the froth flotation procedure. However, the toxic nature of the cyanide makes it unattractive because of its potential adverse environmetal effects. Nokes reagent, which is produced by reaction of phosphorous pentasulfide with caustic soda also presents problems since toxic hydrogen sulfide gas is produced as a by-product. The present invention provides a novel combination of reagents which depress copper and other metal sulfides in the froth flotation of molybdenite without the above undesirable environmental side effects.

SUMMARY OF THE INVENTION

This invention provides a process of froth flotation for the separation of molybdenite from copper, iron and similar metal sulfides by use of a combination of activated carbon and a thio carboxylic acid compound as flotation reagents. Such combinations of reagents are used in a weight ratio of about 1:1.

PRIOR ART

Gibbs, U.S. Pat. No. 2,449,984, describes the use of a series of thio carboxylic acid compounds as depressants for copper and iron sulfides in the froth flotation of molybdenite. Such compounds are defined as having the formula HS-R-COOH or HS-R-COSH in which R represents a saturated aliphatic group or the group CO. Arbiter and Young, U.S. Pat. No. 2,559,104, and Huiatt et al., U.S. Application Ser. No. 900,830, filed Apr. 28, 1978 (published by the National Technical Information Service as PB-282 977), describe the use of activated carbon or charcoal in the froth flotation of molybdenite and separation of copper sulfide therefrom. According to Arbiter et al., the activated carbon is used in conjunction with an oxidizing agent such as the hypochlorites and peroxides. According to Huiatt et al., the activated carbon is employed in a froth flotation process in combination with the injection of steam into the flotation pulp. Henderson, U.S. Pat. No. 2,957,576, discloses the use of activated carbon or charcoal in conjunction with Nokes reagent in a process for the recovery of molybdenite by froth floation.

DESCRIPTION OF THE INVENTION

The reagent combination of the present invention includes a thio carboxylic acid which may be defined by the formula HS-R-COOH or HS-R-COSH in which R represents an aliphatic hydrocarbon group having from 1 to about 5 carbon atoms or the group CO. Such compounds are described in Gibbs' U.S. Pat. No. 2,449,984 and include compounds such as thioglycollic acid, alpha-mercaptobutyric acid, alpha-mercaptocaproic acid, and dithio oxalic acid. The compounds are conveniently used in the form of their water-soluble salts such as the sodium and potassium salts. The presently preferred thio carboxylic acid is thioglycollic acid, also known as mercaptoacetic acid, especially as the salts, sodium thioglycollate or potassium thioglycollate.

The activated carbon or charcoal is well-known to the art and is readily available from several industrial sources. The activated carbon is conveniently used in the form of an aqueous slurry and is employed in a finely divided form such as of about 200 to 400 mesh size. According to the process of the present invention, the activated carbon is added to the flotation pulp prior to addition of the thio carboxylic acid.

The combination of reagents of this invention are preferably employed in a weight ratio of about 1:1 with the amounts required being dependent upon the copper sulfide content of the ore or concentrate being treated. Thus, when a copper sulfide ore having a minor amount of molybdenite is subjected to flotation, a much larger amount of reagent is required. If the ore is a primary molybdenite ore or molybdenite concentrate containing small amounts of copper sulfide, lesser amounts of reagents are required to depress the copper and other metal sulfides. Thus, according to the present invention, about 0.001 to 0.01 lb. of the thio carboxylic acid reagent is used for each pound of copper in the ore or concentrate being subjected to flotation, with about 0.005 lb. being preferred. A similar amount of activated carbon is also used since best results are obtained when the weight ratio of the reagents is about 1:1.

As described above, the activated carbon is added and the flotation pulp is conditioned prior to addition of the thio carboxylic acid. The flotation procedure takes place at about ambient temperature using flotation processing equipment well-known to those skilled in the art. Other well-known flotation reagents may be used, including frothers such as methyl isobutyl carbonol, pine oil and the Dowfroth products, collectors such as diesel oil and vapor oil, flocculants, emulsifiers, dispersants, pH modifiers and other depressants.

The following examples illustrate the process of the present invention. In each example, the amount of reagent added is expressed as per ton of ore.

EXAMPLE 1

Molybdenite ore (18 kg.) assaying 0.265% $MoS_2$ and 0.0035% Cu as calcopyrite was ground to about 22% +100 mesh, treated with known grinding and flotation reagents and submitted to a rougher and scavenger flotation procedure. The rougher concentrate was reground at 50% solids and refloated to give a first cleaner concentrate containing about 0.18% Cu. The resultant concentrate was reground, reagentized, conditioned and submitted to five cleaner flotation procedures as outlined below:

| Stage | Reagents Added, Pounds/Ton of Ore | | | | | | |
|---|---|---|---|---|---|---|---|
| | $Na_2SiO_3$ | $ZnSO_4$ | Stpfl. 85L | Diesel Oil | Pine Oil | MIBC | Lime |
| Primary Grind | 0.50 | | 0.020 | 0.140 | 0.027 | 0.027 | |
| Rougher Float | | | | 0.030 | | | 0.033 |
| Scavenger Float | | | | 0.020 | | 0.016 | |
| 1st Regrind | | | | | | | |
| 1st Cleaner Float | | | | 0.036 | | | |
| 2nd Regrind | 0.100 | 0.200 | | | | | |
| 2nd Cleaner Float | | | | 0.034 | | 0.001 | 0.044 |
| 3rd Cleaner Float | 0.050 | 0.100 | | 0.030 | | | |
| 3rd Regrind | 0.025 | 0.050 | | | | | |
| 4th Cleaner Float | | | | 0.030 | | 0.001 | |
| 5th Cleaner Float | 0.015 | 0.030 | | 0.020 | | 0.001 | 0.014 |
| 6th Cleaner Float | 0.010 | 0.020 | | 0.020 | | | 0.002 |
| Total | 0.700 | 0.400 | 0.020 | 0.360 | 0.027 | 0.046 | 0.093 |

MIBC is methyl isobutyl carbinol.

Stpfl. 85L is Stepanflote 85L, an organic sulfur containing surfactant which is recommended for flotation of molybdenite.

The results are shown in Table I.

EXAMPLE 2

The procedure of Example 1 was repeated except 0.04 pound of activated carbon per ton of ore was added prior to conditioning and flotation in the 2nd through 4th cleaner flotation stages. The results are shown in Table I.

EXAMPLE 3

The procedure of Example 1 was repeated except 0.035 pound of sodium thioglycollate per ton of ore was added prior to the 2nd through 6th cleaner flotation stages. The results are shown in Table I.

EXAMPLE 4

The procedure of Example 1 was repeated except 0.065 pound of sodium thioglycollate per ton of ore was added prior to the 2nd through 6th cleaner flotation stages. The results are shown in Table I.

EXAMPLE 5

The procedure of Example 1 was followed except 0.032 pound/ton ore of activated carbon was added and the reagentized pulp conditioned for 5 minutes and then 0.035 pound/ton ore of sodium thioglycollate added prior to the 2nd through 4th cleaner flotation stages. The results are recorded in Table I.

EXAMPLE 6

The procedure of Example 5 was followed except 0.036 pound/ton ore of activated carbon and 0.065 pound/ton ore of sodium thioglycollate were added. The results are shown in Table I.

TABLE I

| Example | Reagents | Concentrate $MoS_2$ % Recovery | Concentrate Grade (%) $MoS_2$ | Cu | Fe |
|---|---|---|---|---|---|
| 1 | Control | 72.1 | 89.8 | 0.130 | 0.37 |
| 2 | Carbon 0.04 lb./ton | 75.7 | 88.4 | 0.095 | 0.29 |
| 3 | NTG 0.035 lb./ton | 63.6 | 86.7 | 0.050 | 0.35 |
| 4 | NTG 0.065 lb./ton | 62.0 | 90.4 | 0.015 | 0.20 |
| 5 | Carbon 0.032 lb./ton | 78.7 | 87.7 | 0.032 | 0.20 |
| 6 | NTG 0.035 lb./ton<br>Carbon 0.036 lb./ton<br>NTG 0.065 lb./ton | 61.4 | 91.6 | 0.010 | 0.17 |

NTG = sodium thioglycollate

As shown in Table I, when activated carbon is added (Example 2), the $MoS_2$ recovery is increased and the copper and iron content of the concentrate reduced. The addition of NTG (Examples 3 and 4) further reduces the Cu and Fe, but the $MoS_2$ recovery is also reduced. The 1:1 combination of carbon and NTG (Example 5) gives a high recovery of $MoS_2$ with low Cu and Fe content. Although a 1:2 combination of carbon and NTG (Example 6) further reduces the Cu and Fe content of the $MoS_2$ concentrate, the recovery is also lowered substantially. Thus, the 1:1 combination of Example 5 gave an acceptable grade of $MoS_2$ concentrate with good Cu and Fe levels and good $MoS_2$ recovery.

Various changes and modifications of the invention can be made, and to the extent that such variations incorporate the spirit of this invention, they are intended to be included within the scope of the appended claims.

What is claimed is:

1. The method for recovering molybdenite from a flotation concentrate containing primarily molybdenite and minor amounts of sulfides of copper and iron which comprises conditioning said concentrate in aqueous suspension with first about 0.001 to 0.01 pound of activated carbon and then about 0.001 to 0.01 pound of a thio acid of the formula HS-R-COOH or HS-R-COSH or soluble salt thereof and subjecting the suspension of conditioned concentrate to froth flotation at ambient temperature for the recovery of said molybdenite, wherein R represents an aliphatic hydrocarbon group having 1 to about 5 carbon atoms or the group CO, the weight ratio of said carbon and said thio acid is about 1:1 and said pounds of said carbon and said thio acid are per pound of copper in said concentrate.

2. The method according to claim 1 in which said thio acid salt is sodium thioglycollate.

3. The method according to claim 1 in which about 0.005 pound of activated carbon and about 0.005 pound of said thio acid or salt thereof are added for each pound of copper in said concentrate.

4. The method of claim 1 in which said thio acid salt is potassium dithio oxalate.

5. In the method for separating molybdenite from copper sulfide by the froth flotation of an aqueous suspension of molybdenite concentrate containing a minor amount of copper sulfide, the improvement which comprises conditioning said concentrate with, first, activated carbon and, second, a thio acid or soluble salt thereof, and subjecting said conditioned concentrate to froth flotation at ambient temperature, wherein about 0.001 to 0.01 pound of said activated carbon per pound of copper in said concentrate and about an equivalent amount of said thio acid or salt thereof are employed and wherein said thio acid has the formula HS-R-COOH or HS-R-COSH in which R represents an aliphatic hydrocarbon group having from 1 to about 5 carbon atoms or the group CO.

6. The method according to claim 5 in which said thio acid salt is sodium thioglycollate.

7. The method according to claim 6 in which about 0.005 pound each of said activated carbon and sodium thioglycollate are employed for each pound of copper in said concentrate.

8. The method according to claim 5 in which said thio acid salt is potassium dithio oxalate.

* * * * *